US005309739A

United States Patent [19]

Lee

[11] Patent Number: 5,309,739

[45] Date of Patent: May 10, 1994

[54] ULTRASONIC CLOTHES WASHING MACHINE CONTAINING A TOURMALINE CERAMIC COATING

[75] Inventor: Ok K. Lee, Seoul, Rep. of Korea

[73] Assignee: Samsung Electronics Co., Ltd., Suwon, Japan

[21] Appl. No.: 59,855

[22] Filed: May 11, 1993

[30] Foreign Application Priority Data

May 30, 1992 [KR] Rep. of Korea ..... 92-9364

[51] Int. Cl.[5] ..... D06F 39/02

[52] U.S. Cl. ..... 68/3.055; 68/13 R; 68/17 R; 68/17 A

[58] Field of Search ..... 68/355, 13 R, 13 A, 68/17 R, 17 A

[56] References Cited

U.S. PATENT DOCUMENTS 3,087,776 4/1963 Anderson ..... 68/3 SS X
3,134,990 6/1964 Bodine, Jr. ..... 68/3 SS X
3,937,042 2/1976 Loeb ..... 68/12 A
4,875,575 10/1989 Snyder et al. ..... 68/17 A X
5,211,689 5/1993 Kobayashi ..... 68/17 R X

FOREIGN PATENT DOCUMENTS 561627 8/1958 Canada ..... 68/3 SS

*Primary Examiner*—Philip R. Coe
*Attorney, Agent, or Firm*—Burns, Doane, Swecker & Mathis

[57] ABSTRACT

A clothes washing machine comprises a water container and a washing tub disposed in the water container to form a space therebetween for containing wash water. A tourmaline ceramic coating is applied to an outer bottom surface of the washing tub or to an inner surface of the water container for reacting with the wash water to form hydroxyl ions therein which reduce surface tension of the water. An ultrasonic vibrator is mounted on the water container across from the coating to generate waves in the water to accelerate the reaction between the coating and wash water. Alternatively, the tourmaline ceramic coating could be applied to an agitator disposed in the washing tub.

12 Claims, 2 Drawing Sheets

ULTRASONIC CLOTHES WASHING MACHINE CONTAINING A TOURMALINE CERAMIC COATING

BACKGROUND OF THE INVENTION

The present invention relates to a clothes washing machine.

Most clothes washing machines wash the laundry by utilizing the mechanical force of a pulsator and the surface active force of a chemical detergent.

Accordingly, in order to improve the washing efficiency, many clothes washing machine makers have utilized various methods including: improving the pulsator's ability to agitate the laundry, extending the operating time of the motor the water flow time, and improving the quality and/or increasing the quantity of detergent used in the washing machine.

However, there are limits to improvements in the washing efficiency by the aforementioned methods for the following reasons.

The methods utilizing increased mechanical force to improve the washing efficiency may cause damage to the laundry or to efficiency of the clothes washing machine.

In the methods utilizing increased amounts of detergent, a relatively large amount of the detergent which does not react with the laundry is then discharged where it can later cause environmental pollution, and also the remaining detergent sticks to the laundry and thus the laundry is not effectively cleaned.

Also, it is well known that if more than the recommended amount of detergent is used in the clothes washing machine, the washing efficiency of the washing machine is reduced.

SUMMARY OF THE INVENTION

An object of the present invention is to provide a clothes washinq machine with a tourmaline material which causes the electrolysis of the wash water and generates hydroxyl ions causing a surface active effect, thereby lowering the surface tension of the wash water.

Another object of the present invention is to provide a clothes washing machine with an ultrasonic generating apparatus which transmits ultrasonic waves to the wash water which enables the electrolysis process to be accelerated and enables the detergent in the washing tub to be more easily dispersed and dissolved, thereby improving the washing effectiveness of the washing machine.

The tourmaline ceramic coating is applied to the outer wall of the bottom of the washing tub. The ultrasonic generating apparatus includes an ultrasonic vibration plate provided on the inner wall of the bottom of the water container, an ultrasonic vibrator provided on the outer wall of the bottom of the water container, and an ultrasonic generator provided between the water container and the outer tub of a clothes washing machine.

The tourmaline ceramic coating is formed by crystals which are naturally electrically polarized even without the presence of electric power. Due to the electrical polarity, hydroxyl ions are generated in the wash water by the electrolytic action of the tourmaline ceramic coating when it contacts water.

The hydroxyl ions improve the washing effectiveness of the clothes washing machine by lowering the surface tension of the wash water due to the ions' surface active effect, and also it is natural that when the surface tension of the wash water is reduced, the amount of detergent necessary to clean the laundry is also reduced.

On the other hand, ultrasonic waves generated by the ultrasonic generating apparatus cause a cavitation phenomena in the wash water, and the phenomena enhances the electrolytic action of the tourmaline coating and consequently accelerates the generation of the hydroxyl ions.

Further, ultrasonic waves transmitted to the wash water easily disperse and dissolve the detergent so that the washing effectiveness of the clothes washing machine is improved.

As the washing of laundry by a clothes washing machine is generally carried out through successive cycles comprising the water and detergent mixing, washing by agitation, and dehydrating, both the electrolysis of the wash water by the tourmaline ceramic coating, and the dispersion and dissolution of the detergent and the cavitation by ultrasonic waves are effectively performed throughout the process except for the dehydration cycle.

The aforementioned benefits can also be obtained by coating the pulsator with the tourmaline ceramic except that the tourmaline ceramic coating is attached to the outer wall of the bottom of the washing tub.

As described above, the advantages of the present invention consist, in particular, in the fact that the washing efficiency of the clothes washing machine is improved and the amount of detergent needed is reduced due to the surface active effect of the hydroxyl ions generated by the tourmaline ceramic coating and the ultrasonic vibration plate.

Further desirable advantages are that environmental pollution is reduced and it provides improved sanitary benefits for the human body by the reduction of the amount of detergent used.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
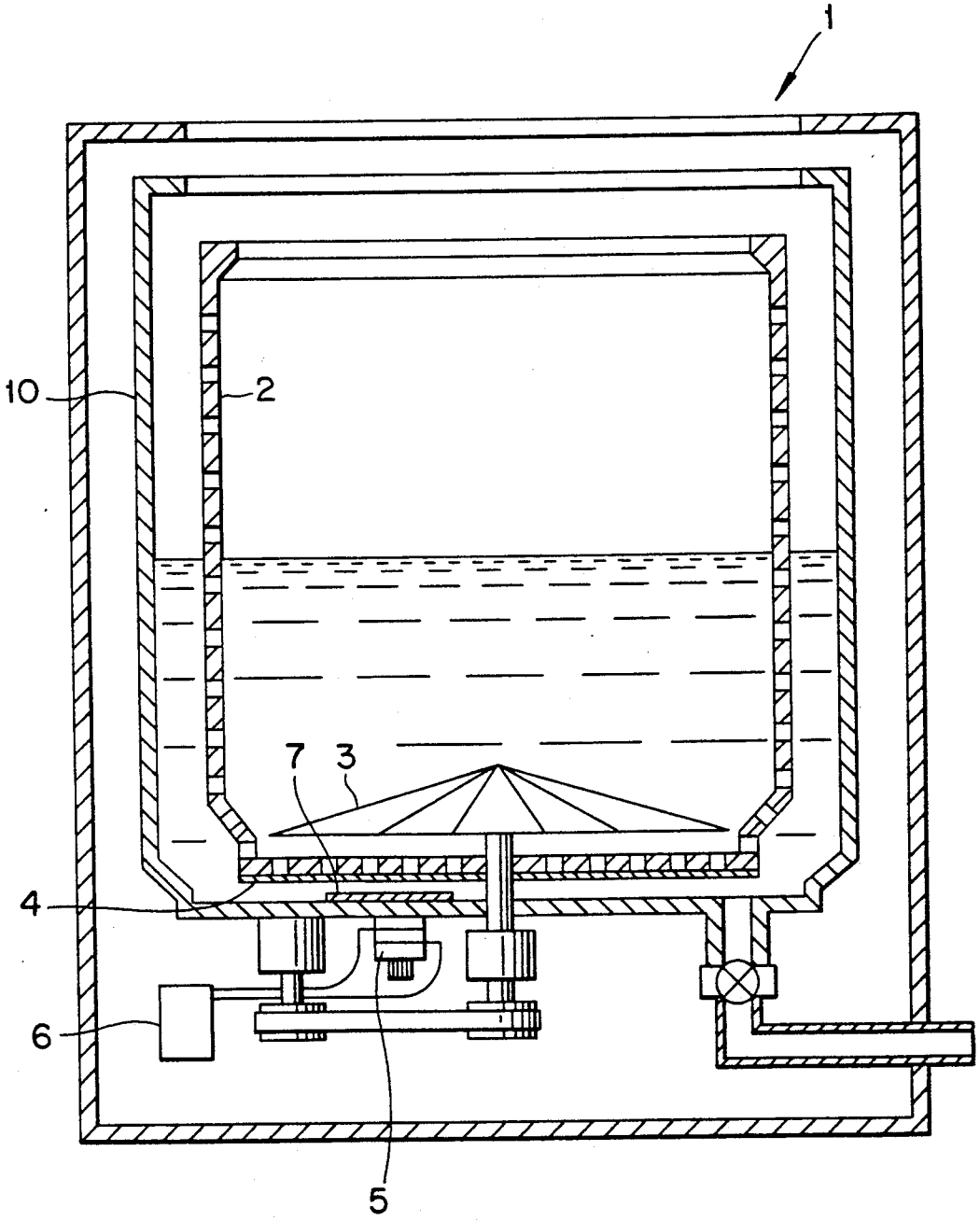
FIG. 1 is a cross-sectional view of an ultrasonic clothes washing machine including a tourmaline ceramic coating and an ultrasonic generating apparatus.

As illustrated in FIG. 1, the present invention comprises an ultrasonic generating apparatus including an ultrasonic generator 6, an ultrasonic vibration plate 7, and an ultrasonic vibrator 5 installed in the bottom of a water container 10 of a clothes washing machine, and a tourmaline ceramic coating 4 applied to the outer wall of the bottom of washing tub 2 of the washing machine.

In the operation of an ultrasonic clothes washing machine according to the present invention constituted as described above, when the washing machine is turned on to wash the laundry, water is initially supplied to the washing tub 2 and it simultaneously comes into contact with the tourmaline ceramic coating 4 applied to the bottom of the washing tub 2.

From that moment, hydroxyl ions having a surface active effect are generated in the wash water by the electrolytic action of the tourmaline coating.

At the same time, ultrasonic waves generated by the operation of the ultrasonic generator 6 are transmitted to the ultrasonic vibration plate 7 provided in the bottom of the water container 10 through the ultrasonic vibrator 5 and finally transmitted to the wash water.

The ultrasonic waves cause the water in the washing tub 2 to travel to the cavitation which accelerates the electrolysis of the wash water in combination with the tourmaline ceramic coating 4 so that a large amount of the hydroxyl ions are generated.

Consequently, the washing performance of the clothes washing machine is improved by the tourmaline ceramic coating 4 in combination with the ultrasonic generating apparatus.

Furthermore, detergent placed in the washing machine is more easily dispersed and dissolved by the ultrasonic effect.

Figure 4:
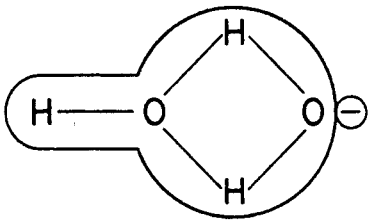
FIG. 4 is the constitutional formula of an hydroxyl ion.

As illustrated in FIG. 4, an hydroxyl ion consists of H—O—H which is an hydrophilic radical and H—O which is an hydrophobic radical (in particular, the H portion serves as an hydrophobic radical) so that the hydrophilic radicals face in the direction of the water molecules and the hydrophobic radicals in the opposite direction.

The condition of the hydroxyl ion as described above is the most stable condition for the hydroxyl ion.

The hydroxyl ions serve as a surface activator which lowers the surface tension of the wash water.

It is commonly known that if the surface tension of water is reduced, the actions like emulsifying, dispersion, permeation etc. are highly activated in the wash water so that the dirt, grease and the like are more easily separated from the laundry.

Figure 3:
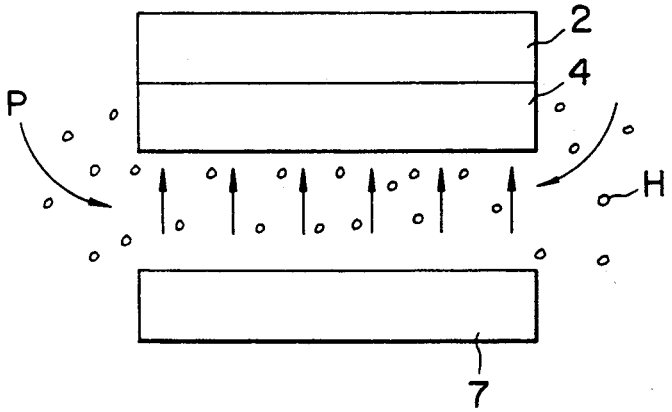
FIG. 3 is a view showing the generation of hydroxyl ions($H_3O_2$) in the wash water by an ultrasonic vibration plate and a tourmaline ceramic coating.

FIG. 3 illustrates the phenomena whereby hydroxyl ions are generated in the wash water by the tourmaline ceramic coating 4.

The cohesion of the water molecules flowing in the direction of the arrow 'P', is weakened due to the cavitation effect of the ultrasonic waves and then the hydroxyl ions are generated from the wash water as the water is electrolyzed by the effect of the tourmaline coating.

The washing action of the detergent will now be discussed.

When the detergent is placed in the wash water, the surface tension of the wash water is reduced by the surface active agent existing in the detergent whereby the separation of the dirt and the dispersion, emulsifying and permeation of the detergent is facilitated.

The surface tension of the wash water in a 0.2% concentration of surface active agent is in general 33.8 dyne/cm which is about one half that of normal water (about 72.8 dyne/cm at 20 deg. C.).

The amount of detergent required for the washing is reduced in proportion to the reduction in the surface tension of the water due to the action of the hydroxyl ions generated by the electrolysis of the water due to the tourmaline ceramic coating 4.

The generation of the hydroxyl ions also continues during the washing process because the effect of the tourmaline ceramic coating 4 and the ultrasonic vibration plate 7 described above continue while the wash water circulates during the washing process and thereafter as well during the water supply cycle.

Figure 2:
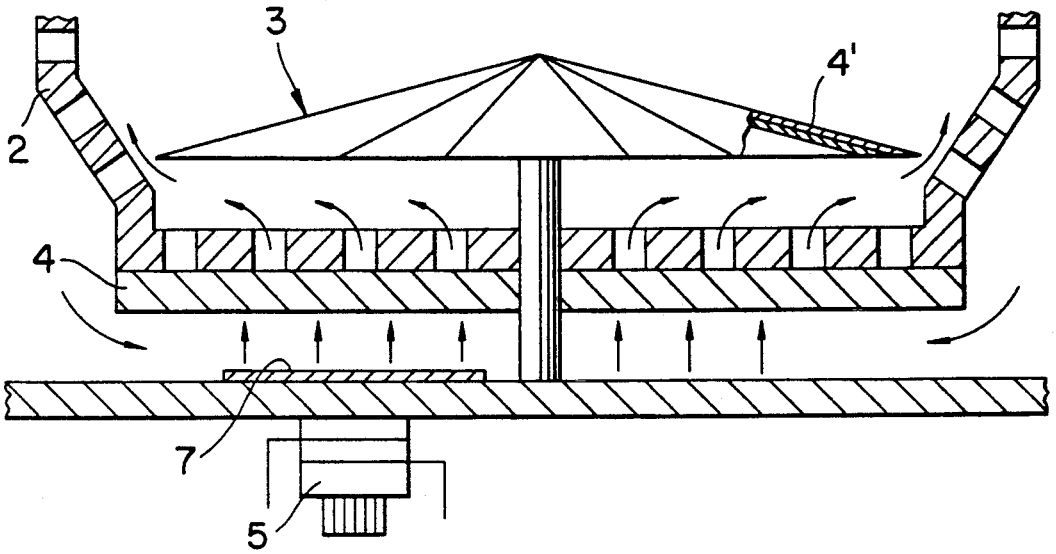
FIG. 2 is an enlarged view of a tourmaline ceramic coating and an ultrasonic generating apparatus illustrated in FIG. 1.

In addition to being disposed on the bottom surface of the wash tub 2, tourmaline material 4' could comprise a coating 4' provided on the pulsator 3 as illustrated in FIG. 2.

What is claimed is:

1. A clothes washing machine comprising:
a water container;
a wash tub disposed in said water container to form a space therebetween for containing wash water;
a tourmaline material disposed in said space for reacting with the wash water to form therein hydroxyl ions for reducing surface tension of the wash water; and
wave generating means communicating with said space for generating waves in the wash water in the vicinity of said tourmaline material for accelerating the reaction between said tourmaline material and the wash water.

2. A clothes washing machine according to claim 1, wherein said wave generating means comprises an ultrasonic wave generator.

3. A clothes washing machine according to claim 1, wherein said tourmaline material comprises a tourmaline ceramic material.

4. A clothes washing machine according to claim 3, wherein said tourmaline ceramic material comprises a coating applied to a portion of said wash tub.

5. A clothes washing machine according to claim 1, wherein said tourmaline material is disposed on an outer surface of said wash tub, and said wave generating means is disposed on said water container.

6. A clothes washing machine according to claim 5, wherein said outer surface is located on a bottom of said wash tub.

7. A clothes washing machine according to claim 6, wherein said wave generating means comprises an ultrasonic wave generator.

8. A clothes washing machine according to claim 7, wherein said ultrasonic wave generator comprises an ultrasonic vibration plate disposed on an inner bottom surface of said water container across from said tourmaline material, an ultrasonic vibrator disposed on an outer bottom surface of said water container, and a generator member connected to said ultrasonic vibrator.

9. A clothes washing machine according to claim 1 including an agitator disposed in said wash tub, and a tourmaline material affixed to said agitator.

10. A clothes washing machine comprising:
a water container;
a wash tub disposed in said water container such that an internal surface of said water container is spaced from an external surface of said wash tub to form a space therebetween for containing wash water; and a tourmaline material disposed in said space for reacting with the wash water to form therein hydroxyl ions for reducing surface tension of the wash water.

11. A clothes washing machine according to claim 10, wherein said tourmaline material is affixed to an outer bottom surface of said wash tub.

12. A clothes washing machine comprising:
a water container;
a wash tub disposed in the water container;
an agitator disposed in the wash tub; and
a tourmaline material affixed to said agitator for reacting with the wash water to form therein hydroxyl ions for reducing surface tension of the wash water.

* * * * *